US006568355B2

(12) United States Patent
Suzuki

(10) Patent No.: US 6,568,355 B2
(45) Date of Patent: May 27, 2003

(54) ENGINE GENERATOR

(75) Inventor: Misao Suzuki, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/835,139

(22) Filed: Apr. 13, 2001

(65) Prior Publication Data

US 2001/0029906 A1 Oct. 18, 2001

(30) Foreign Application Priority Data

Apr. 14, 2000 (JP) ..... 2000-113399

(51) Int. Cl.[7] ..... F02B 63/04
(52) U.S. Cl. ..... 123/2; 290/1 A
(58) Field of Search ..... 123/2; 290/1 A

(56) References Cited

U.S. PATENT DOCUMENTS

| | | | | |
|---|---|---|---|---|
| 2,543,541 A | | 2/1951 | Angle | |
| 4,677,940 A | * | 7/1987 | Bracht et al. | 123/2 |
| 4,779,905 A | * | 10/1988 | Ito et al. | 123/2 |
| 4,859,886 A | * | 8/1989 | Tanaka et al. | 123/2 |
| 5,546,901 A | * | 8/1996 | Acker et al. | 123/195 A |
| 5,890,460 A | | 4/1999 | Ball | |
| 6,095,099 A | * | 8/2000 | Morohoshi et al. | 123/2 |

FOREIGN PATENT DOCUMENTS

| | | |
|---|---|---|
| DE | 3825349 | 2/1989 |
| GB | 2168203 | 6/1986 |

OTHER PUBLICATIONS

Patent Abstracts of Japan, vol. 012, No. 057, Feb. 20, 1988 & JP 62 203918 (Honda Motor Co Ltd), Sep. 8, 1987.
Patent Abstracts of Japan, vol. 2000, No. 03, Mar. 30, 2000 & JP 11343859 A (Mitsubishi Heavy Ind Ltd), Dec. 14, 1999.
JP 11–36880 Feb. 9, 1999.
JP 58–197417 Nov. 17, 1983.
JP 58–197415 Nov. 17, 1983.

* cited by examiner

*Primary Examiner*—Noah P. Kamen
(74) *Attorney, Agent, or Firm*—Martin A. Farber

(57) ABSTRACT

An engine generator includes an engine, a generator having a generating unit including an outer rotor and a stator, and a cooling fan disposed between the engine and the generator. The generating unit is housed within a fan cover which is provided for accommodating the cooling fan, the stator being mounted to the inner side of the fan cover. As the single fan cover encloses the generating unit, a reduction in the number of components and an improvement in water-proof performance are achieved. The stator can be separated and replaced simply by removing the fan cover without dismounting other components, whereby maintenance is facilitated and the number of working steps is reduced.

1 Claim, 6 Drawing Sheets

ENGINE GENERATOR

BACKGROUND OF THE INVENTION

1. Field of the Invention

The present invention relates to an engine generator composed of an engine and an engine-driven generator, and particularly to an engine generator which cools the interior thereof by an engine-driven cooling fan.

2. Description of the Related Prior Art

An engine-driven generator accommodated within a box-like housing for the generation of electricity is widely used as a power source at road construction sites, in street stalls, or for outdoor leisure. Japanese Patent Application Laid-open Publication No. 58-197415 and No. 58-197417 disclose such an engine generator. Here, an engine, an inner-rotor type generator, a muffler and others are accommodated in a main housing. The rotor of the generator is rotated by a crankshaft of the engine to generate an electromotive force on the side of the stator. A cooling fan is interposed between the engine and the generator so that it is rotated with the crankshaft for introducing cooling air into the main housing, thereby cooling the engine and the generator.

The cooling fan and the generator in this engine generator are further covered by a front housing and a rear housing, respectively, within the main housing. The front housing is attached to a side of an engine cover accommodating the engine therein and accommodates the cooling fan. The rear housing is mounted to the outer side of the front housing opposite to the engine, with the stator being fixedly interposed therebetween. The crankshaft is rotatably supported at an outer end of the rear housing.

When starting the engine by a recoil starter, the crankshaft starts to rotate, whereby the rotor rotates in the vicinity of the stator and electricity is generated. The cooling fan is at the same time rotated so that air is introduced into the main housing from the outside to cool the interior of the engine generator.

Japanese Patent Application Laid-open Publication No. 11-36880 is directed to an improvement in cooling efficiency of such an air-cooled engine generator which uses a cooling fan. FIG. 6 is a side view with a partial cross section illustrating the generator and the vicinity thereof in the engine generator according to this publication.

A generator 51, an engine 52, and a muffler (not shown) are arranged in this order within a housing (not shown), these being enclosed in a duct 53 and a fan cover 54. The generator 51 is of an outer-rotor type, its stator 55 being fixed to the engine 52. An outer rotor 57 coupled to a crankshaft 56 is disposed on the outside of the stator 55. A cooling fan 58 is mounted to an outer side of the outer rotor 57, to be driven to rotate with the crankshaft 56 for introducing cooling air 59.

The cooling air 59 first cools the generator 51 of which temperature is relatively low, and further cools the engine 52 and the muffler having a higher temperature sequentially, after which it is discharged to the outside. In this way, the engine generator of this disclosure is intentionally capable of efficiently cooling the interior of the generator 51, as well as it allows itself to be made compact by the use of the outer-rotor type generator.

While the engine generator disclosed in Japanese Patent Application Laid-open Publication No. Hei. 11-36880 offers an improvement in the cooling efficiency of the generator and a reduction in size, replacement of the stator 55 entails a complicated operation of disassembling some components. That is, after removing the fan cover 54, the cooling fan 58 and the outer rotor 57 must be dismounted. Thus the maintenance of the apparatus imposes demanding work because of the internal structure which does not allow the stator to be readily replaced.

The engine generator disclosed in the above-mentioned Japanese Patent Application Laid-open Publication No.58-197415 or No.58-197417 has a structure wherein the stator is interposed between the front housing and the rear housing. Accordingly, the stator can be replaced simply by removing the rear housing. On the other hand, the generator of this type is inherently long in its axial direction, because of which a reduction in size of the apparatus is hard to achieve. Moreover, the number of components are inevitably increased and so are the number of assembling steps, because the inner housing is composed of two separate parts.

SUMMARY OF THE INVENTION

An object of the present invention is to provide a small, light-weight engine generator which allows itself to be readily disassembled and assembled for easy maintenance.

An engine generator according to the present invention includes an engine, a generator having a rotor and a stator and driven by the engine, a cooling fan driven by the engine, and a fan cover for enclosing the cooling fan therein. In this construction, the rotor and the stator are accommodated within the fan cover.

According to the invention, in an engine generator including an engine, a cooling fan, and a generator, the rotor and the stator are accommodated within a single fan cover, whereby the number of components is reduced and waterproof performance is improved.

The stator may be mounted to the fan cover, so that the stator can be separated from the generator simply by removing the fan cover. As a result, the stator can be replaced without removing other components, whereby maintenance is facilitated and the number of working steps is reduced.

The cooling fan may be disposed between the engine and the generator in the engine generator according to the invention. Further, the generator may be an inner-rotor type generator, or alternatively, it may be an outer-rotor type generator.

BRIEF DESCRIPTION OF THE DRAWINGS

These and other objects and advantages of the present invention will become more clearly understood from the following description with reference to the accompanying drawings, wherein.

DETAILED DESCRIPTION OF THE PREFERRED EMBODIMENTS

Preferred embodiments of the present invention will be hereinafter described in detail with reference to the accompanying drawings.

(First Embodiment)

Figure 1:
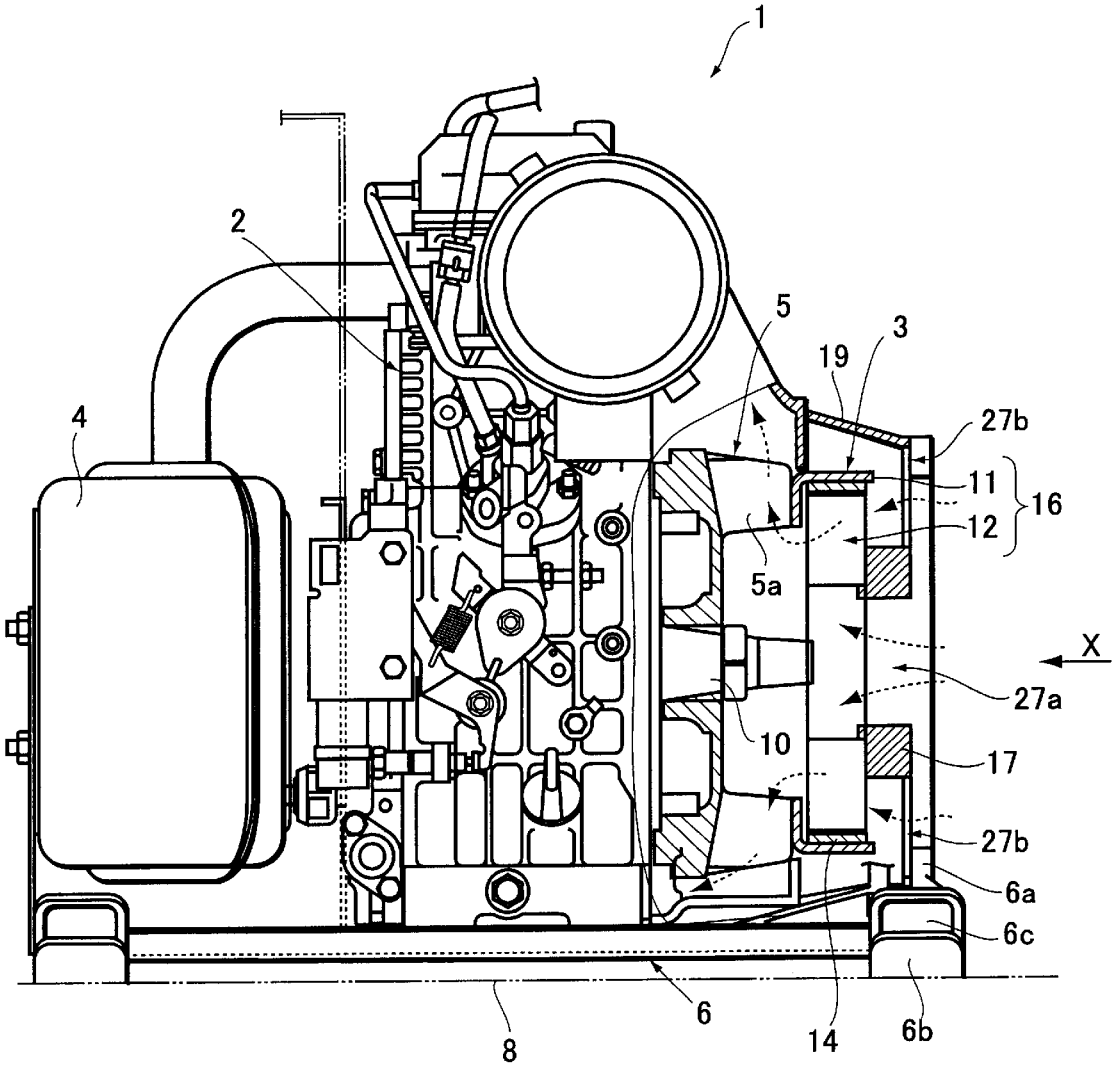
FIG. 1 is a side view diagram illustrating the internal structure of an engine generator of the present invention according to one embodiment thereof.
Figure 2:
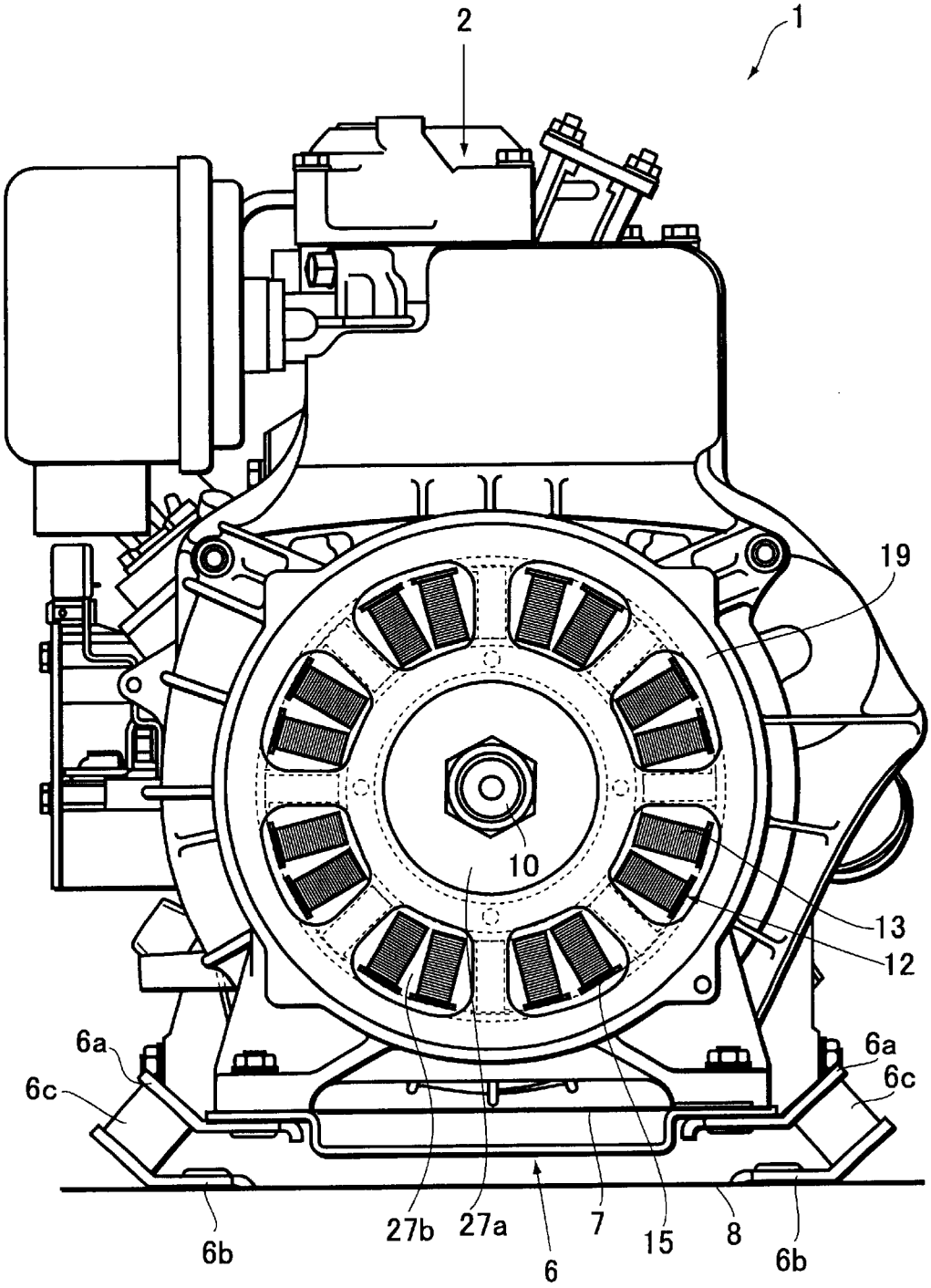
FIG. 2 is a diagram illustrating the engine generator of the present invention when viewed form a direction of the arrow X in FIG. 1.

FIG. 1 is a diagram illustrating the internal structure of an engine generator according to a first embodiment of the invention viewed from a side, and FIG. 2 is a diagram illustrating the engine generator viewed from a direction of the arrow X in FIG. 1.

The engine generator 1 of this embodiment is a generating apparatus in which a generator is driven by an engine. The engine 2 is placed upon a base 8 together with the generator 3, a muffler 4, a cooling fan 5 and others, all of these being accommodated within a box-like housing (not shown). The generator 3 of the engine generator 1 is an outer-rotor type multipolar generator having a generating unit 16 composed of outer rotors 11 and stators 12. The generating unit 16 is housed within a fan cover 19 which is provided for accommodating the cooling fan therein. The stator 12 of the generating unit 16 is attached to the fan cover 19, thereby allowing itself to be replaced only by dismounting the fan cover 19.

The engine 2 is a general-purpose diesel engine having a crankshaft 10 for driving the generator 3 disposed on the right side of the engine 2 in FIG. 1. Exhaust gases produced by the engine 2 are drawn into the muffler 4 on the left side of the engine in FIG. 1, where the exhaust noise is muffled, and are discharged to the outside through a discharge port (not shown).

The engine 2 is supported on the base 8 through an anti-vibration support member 6. The anti-vibration support member 6 is held on a pair of right and left anti-vibration plates 6*a*, brackets 6*b* attached on the base 8, and vibration absorbers 6*c* interposed between the anti-vibration plates 6*a* and the brackets 6*b*. The vibration absorber 6*c* is made of rubber or synthetic resin and prevents vibration generated by the engine 2 in operation from being transmitted to the base 8. The engine vibration is thus reduced and a soundproof effect of the apparatus is achieved in view of such anti-vibration support member 6 for holding the engine 2 thereon.

The cooling fan 5 which also serves as a flywheel is fixed to the crankshaft 10 of the engine 2. The cooling fan 5 includes a blade 5*a* on the outer circumference thereof which projects towards a side opposite from the engine 2, and the outer rotor 11 formed in a bottomed cylindrical shape is fixed to the end of the blade 5*a*. With the engine being operated, the cooling fan 5 rotates, whereupon the air is induced into the apparatus from the right side in FIG. 1 through inlets 27*a*, 27*b* formed in the fan cover 19 as shown by broken lines. Thus cooling air is provided towards the engine 2.

The outer rotor 11 is attached to the cooling fan 5, with its open end facing opposite the engine 2. A plurality of magnets 14 are arranged circumferentially on the inner wall surface of the outer rotor 11. The combination of the stator 12 and the outer rotor 11 form the generating unit 16.

The stator 12 has a stator core 15 from which a plurality of yolks having generating coils 13 wound therearound project radially, as shown in FIG. 2. Upon activation of the engine 2, the outer rotor 11 starts to rotate, causing the magnets 14 to rotate around the generating coils 13, whereby an electromotive force is generated in the generating coils 13, and thus electricity is generated.

As described above, the engine generator 1 according to the invention employs an outer-rotor type generator 3. Thus, allowing the apparatus to be designed in a small and light-weight fashion. Particularly, its length in the axial direction is made shorter, as compared to the apparatus disclosed in the above-mentioned Japanese Patent Application Laid-open Publication No. 58-197415 or the like. However, with a structure in which replacement of the stator involves dismounting of the cooling fan and the rotor as is the case with apparatus disclosed in Japanese Patent Application Laid-open Publication No. 11-36880, such problems as poor maintenance work efficiency and increased work steps would arise as described above.

For this reason, the engine generator 1 according to the invention adopts a structure whereby the stator 12 can be replaced simply by removing the fan cover 19, i.e. the stator 12 is fixed to the inner side of the fan cover 19. The fan cover 19 has a stator mounting piece 17, illustrated at the right said end in FIG. 1, which projects towards the engine 2 side. The stator 12 is fixedly mounted to and within the fan cover 19 by this stator mounting piece 17. Thus, with the fan cover 19 being mounted to the engine 2, the stator 12 is set inside of the outer rotor 11, thereby forming the generator 3.

Accordingly, when the fan cover 19 is removed for maintenance, the stator 12 attached thereto also comes off from the engine generator 1 together with the fan cover 19. Thus the stator 12 can be replaced without the need of dismounting other components such as the outer rotor 11 as in the prior art described in the foregoing. In this way, maintenance is facilitated and the number of working steps is reduced.

Moreover, the fan cover 19 mounted to the engine 2 accommodates the generating unit 16 in its entirely therein. Therefore, separate housings are not necessary for holding the generator 3, leading to a reduction in the number of components, and also the water-proof property of the engine generator is improved.

The electromotive force generated in the generating coils 13 is fed to an inverter unit (not shown), where it is transformed into an alternating current having a predetermined frequency before being output from a control panel provided within the housing of the engine generator. Generated power is thus output after converting frequencies through the inverter unit because, otherwise, the speed of the engine would have to be adjusted to a fixed value regardless of the variously changed load, in order to maintain a constant output frequency. Accordingly, the engine can run under suitable conditions in accordance with the changes in load. As a result, it is made possible to generally reduce the speed of the engine except when it takes a large load, leading to decreased noise and reduced fuel cost.

Although not shown, a recoil starter is provided on the outside of the fan cover 19, with which the crankshaft 10 is rotated by pulling a rope to start the engine 2.

As described above, the engine generator 1 according to the invention has the stator 12 attached to the fan cover 19, whereby the stator 12 can be replaced by simply removing the fan cover 19 without dismounting other components such as the outer rotor 11. Thus the apparatus can be readily disassembled and assembled with a fewer number of working steps for maintenance such as the replacement of the stator 12.

(Second Embodiment)

Figure 3:
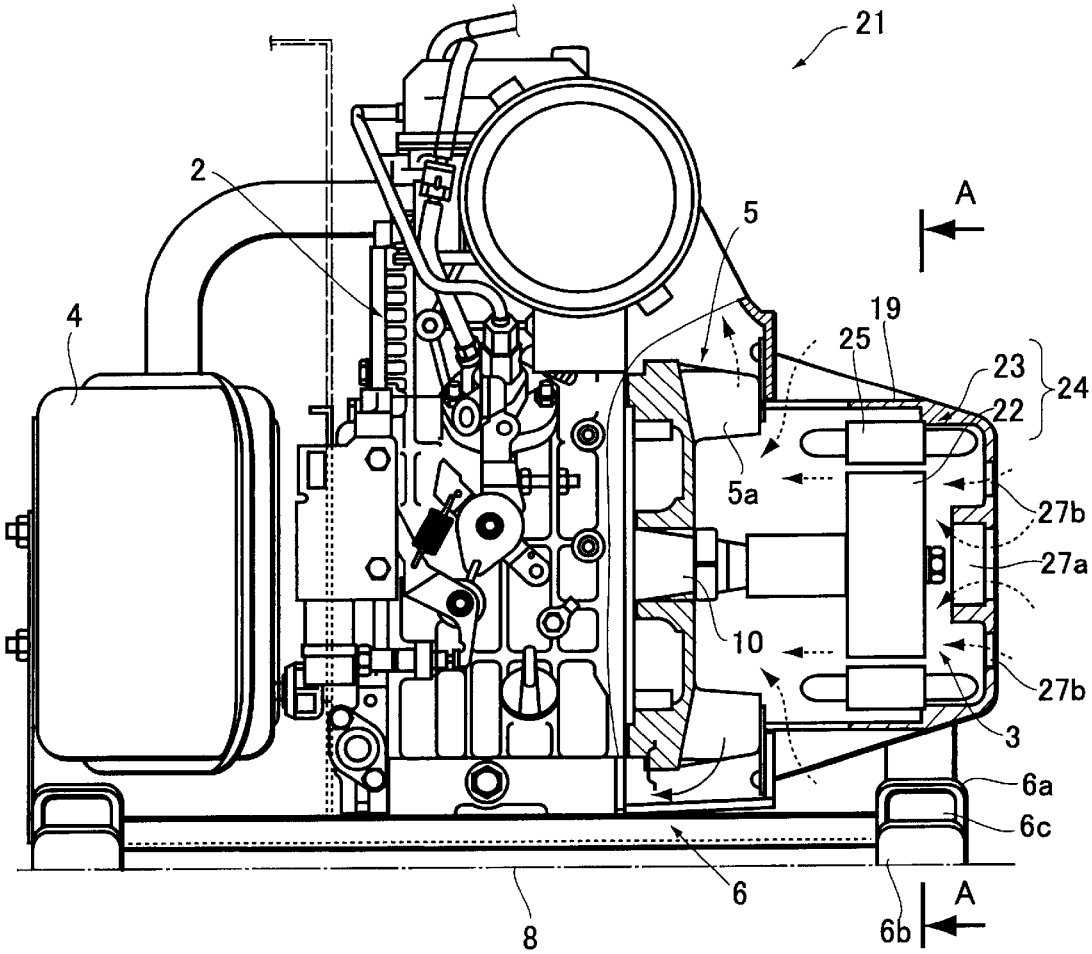
FIG. 3 is a side view diagram of an engine generator of the present invention illustrating the internal structure of an engine generator according to another embodiment thereof.
Figure 4:
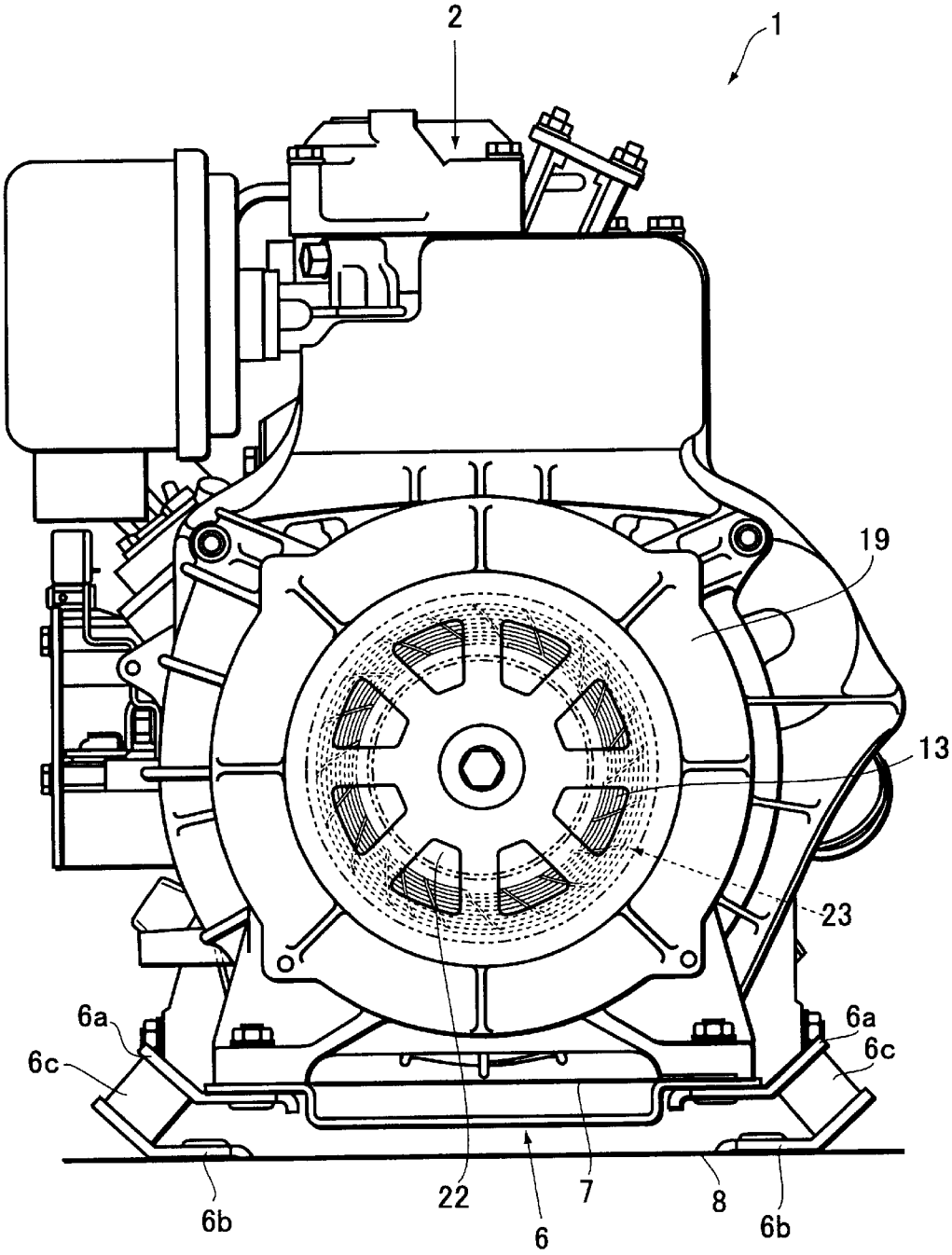
FIG. 4 is a cross-sectional view of the present invention taken along the line A—A in FIG. 3.

Next, an engine generator according to a second embodiment of the present invention employing an inner-rotor type generator 3 will be described. FIG. 3 is a diagram illustrating the internal structure of an engine generator 21 according to the second embodiment viewed from a side, and FIG. 4 is a cross-sectional view taken along the line A—A in FIG. 3.

Elements and components common to the engine generator 1 of the above-described first embodiment are given the same reference numerals, and the description thereof will be omitted.

The generator 3 of this engine generator 21 is composed of a generating unit 24 having inner rotors 22 and stators 23 and being entirely covered by a fan cover 19. The inner rotor 22 is coupled to the crankshaft 10 of the engine 2, and a plurality of magnets (not shown) are fixed on an outer peripheral surface thereof in a circumferential arrangement. The stator 23 is attached to an inner side of the fan cover 19, so that, with the fan cover 19 being mounted to the engine 2 side, the stator 23 is brought to a position facing the inner rotor 22 arranged rotatable on the inner side of the stator 23. Coils 25 are wound around the stator 23 so that an electromotive force is generated in the coils 25 by rotating the magnets on the inside of the coils 25.

As described above, the engine generator 21 likewise has the stator 23 fixed to the fan cover 19 so that it is separable from the apparatus simply by removing the fan cover 19. Therefore, the stator 23 can be replaced without removing other components such as the inner rotor 22 and, similarly to the above-described first embodiment, maintenance is facilitated and the number of working steps is reduced.

Moreover, while the prior art inner-rotor type generator required a front and a rear housings for fixing the stator 23, the arrangement according to the invention requires only one fan cover 19 for covering the generating unit 24 in its entirety, whereby the number of components is reduced and the water-proof property of the engine generator is improved.

The entire length of the engine generator 21 of this embodiment is somewhat longer than that of the engine generator 1 of the above-described first embodiment in view of the inner-rotor type generator 3 employed therein. On the other hand, the arrangement of this embodiment enables existing components to be used, thereby achieving cost savings.

(Third Embodiment)

Figure 5:
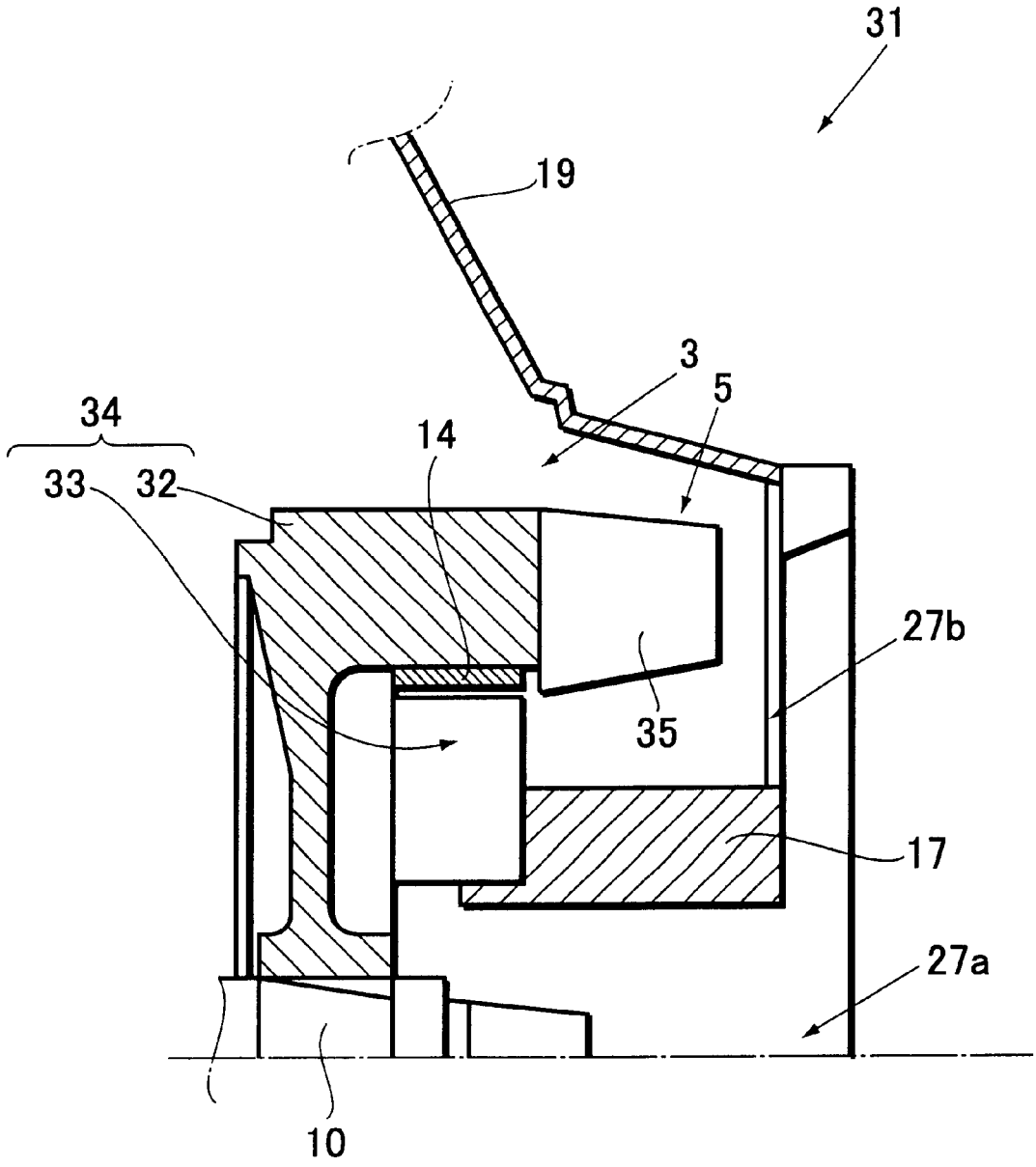
FIG. 5 is a diagram illustrating principal parts of an engine generator of the present invention according to yet another embodiment thereof.
Figure 6:
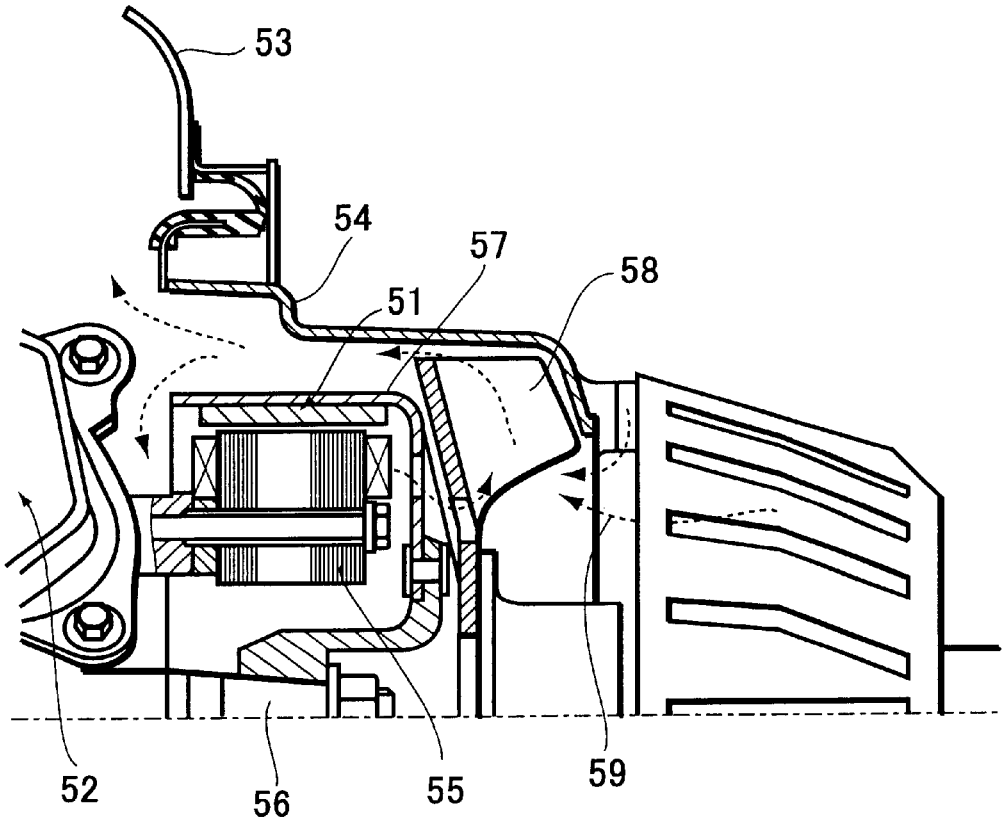
FIG.6 PRIOR ART
FIG. 6 is a side view with a partial cross section illustrating a generator and the vicinity thereof in a conventional engine generator.

Next, as a third embodiment of the present invention, a modification of the engine generator employing the outer-rotor type generator 3 will be described. FIG. 5 is a diagram illustrating principal parts of an engine generator 31 according to the third embodiment of the invention. Elements and components common to the engine generator 1 of the above-described first embodiment are given the same reference numerals, and the description thereof will be omitted.

The engine generator 31 shown in FIG. 5 has an outer rotor 32 which also serves as a cooling fan 5, and a stator 33 inserted to the inner side of the outer rotor 32 from the side of the fan cover 19, so that facilitation of maintenance and a decrease in length of the generator in its axial direction are both achieved.

Like the above-described engine generator of the first embodiment, the generator 3 of this engine generator 31 includes a generating unit 34 having the outer rotor 32 and the stator 33 and being entirely accommodated within the fan cover 19. The outer rotor 32 is formed in a bottomed cylindrical shape, and mounted to the crankshaft 10 with its open end facing opposite the engine 2 side. A blade 35 is formed at the right side end (opposite to the engine 2) on the outer periphery of the outer rotor 32, thereby forming the cooling fan 5 together with the outer rotor 32. A plurality of magnets 14 are fixed on an inner peripheral surface of the outer rotor 32 in a circumferential arrangement.

The stator 33 is formed to have a smaller diameter than the inner diameter of the cooling fan 5, and mounted to an inner side of the fan cover 19 by a stator mounting piece 17. That is, the stator 33 can be inserted to the inside of the outer rotor 32 through the open end of the outer rotor 32. Accordingly, with the fan cover 19 being mounted to the engine 2 side, the stator 33 is brought to a position inside the outer rotor 32, with its coils (not shown) opposing the magnets 14 of the outer rotor 32. Upon start-up of the engine 2, the outer rotor 32 rotates, causing the magnets to rotate on the outside of the coils, whereby an electromotive force is generated in the coils and thus electricity is generated.

As described above, the engine generator 31 according to the third embodiment likewise has the stator 33 fixed to the fan cover 19, so that the stator 33 can be separated from the apparatus simply by removing the fan cover 19. Therefore, the stator 33 can be replaced without removing other components such as the outer rotor 32, and similarly to the above-described first and second embodiments, maintenance is facilitated and the number of working steps is reduced.

Although the invention devised by the present inventors has been described in specific terms in connection with the preferred embodiments thereof, it should be noted that the subject matter of the invention is not limited to such preferred embodiments, and various changes and modifications may be made unless they depart from the subject matter of the invention.

For example, a gasoline engine can of course be used instead of the general-purpose diesel engine as described in the preferred embodiments.

What is claimed is:

1. An engine generator comprising:

an engine;

a generator driven by said engine, said generator including a rotor and a stator;

a cooling fan driven by said engine;

and a fan cover for enclosing said cooling fan therein, wherein said rotor and said stator are accommodated within said fan cover, said stator is mounted to said fan cover and said generator is an outer-rotor type generator.

* * * * *